United States Patent [19]

Jackson

[11] 4,407,217

[45] Oct. 4, 1983

[54] DISTRIBUTION AND TREATMENT MEANS

[75] Inventor: Frederick D. Jackson, Dandenong, Australia

[73] Assignee: Jaybee Engineering Pty. Limited, Dandenong, Australia

[21] Appl. No.: 363,071

[22] Filed: Mar. 29, 1982

[51] Int. Cl.[3] ..... B05B 3/10

[52] U.S. Cl. ..... 118/24; 118/303; 239/223

[58] Field of Search ..... 118/303, 24; 427/212, 427/221, 3; 239/214.11, 223, 224, 226, 700–703; 426/303; 366/155, 168

[56] References Cited

U.S. PATENT DOCUMENTS

| | | | |
|---|---|---|---|
| 2,711,926 | 6/1955 | Allander | 239/224 |
| 2,955,956 | 10/1960 | Baugh et al. | 118/303 X |
| 3,288,052 | 11/1966 | Hough | 118/303 X |
| 4,318,941 | 3/1982 | Gillett et al. | 118/303 X |

FOREIGN PATENT DOCUMENTS

| | | | |
|---|---|---|---|
| 365342 | 10/1931 | United Kingdom | 239/223 |

*Primary Examiner*—John P. McIntosh
*Assistant Examiner*—Mary Beth Calligaris
*Attorney, Agent, or Firm*—Andrus, Sceales, Starke & Sawall

[57] ABSTRACT

An apparatus to distribute discrete particles and, while distribution is occurring means to coat the particles, uniformly with a liquid. The apparatus provides feeding the particles to a rotating plate which rotates at a speed such as to distribute the particles and to cause them to move outwardly to the edge of the plate from which they fall and a liquid distributing means comprising an annular skirt coaxial with and below the plate, the skirt receiving liquid internally thereof and rotating at a speed sufficient to expell the liquid outwardly from its lower edge towards the particles falling from the plate thereby coating these articles.

9 Claims, 2 Drawing Figures

DISTRIBUTION AND TREATMENT MEANS

Figure 1:
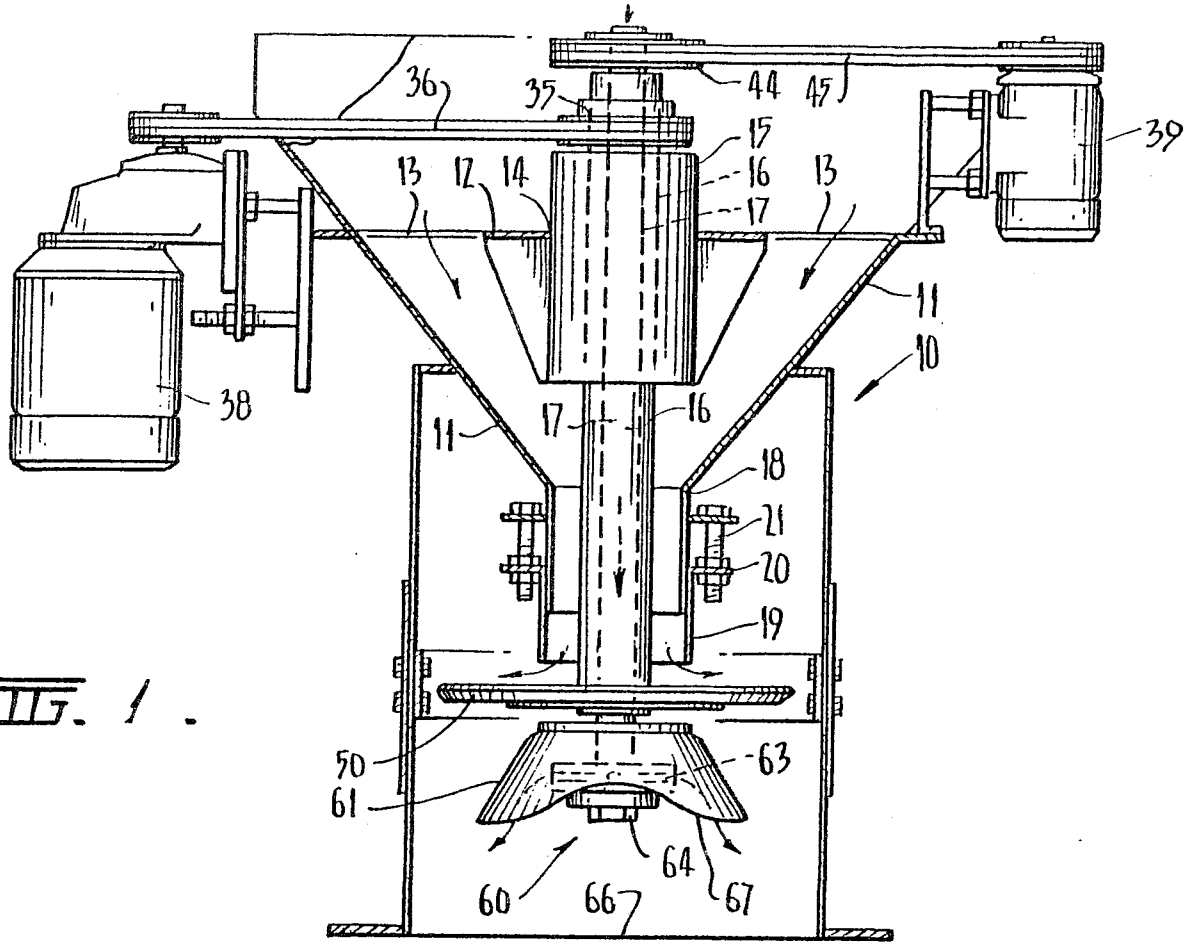

This invention relates to a distribution means for discrete articles and to a means whereby, during distribution, these articles can be treated with a liquid.

There are applications where the even distribution of articles over an area may be most desirable.

It is also often desirable that such articles be coated with liquid at some stage after distribution and, preferably, have time to absorb or permit the liquid to dry before they can conglomerate.

Whilst in this specification we will, for ease of description and simplicity of understanding, refer to the application of the invention to pellets, such as those for use as an animal food, and to discuss coating such pellets with fat, as such a coating is often used to provide the correct nutrient composition for the pellet, as well as increasing their attractiveness as a food, it is to be understood that the invention has substantially broader applications.

There are also applications where coating of articles is required and in many applications to provide an even coating without completely immersing articles has been difficult. For example, pharmaceutical tablets often need to be coated with a protective, decorative or flavour layer after manufacture.

Further, the range of sizes of articles to which the invention may be applied is wide and the invention may be used with articles which are small up to articles of quite substantial size.

It is a first object of this invention to provide a means for distribution of discrete articles and a further object to provide, in association with such distribution means, a means whereby the articles, during distribution, are coated with a liquid.

In a first aspect the invention includes an apparatus for the distribution of discrete articles comprising supply means whereby a continuous feed of the articles can be passed to a downwardly directed delivery means from which the material can be delivered to a plate which is rotating at a speed sufficient to provide a force to move the articles both circumferentially, to evenly distribute these about the plate, and outwardly to the periphery of the plate from which the articles may fall to a receiving means therebeneath.

In another aspect of the invention we provide an apparatus for the distribution and coating of discrete articles comprising a distribution apparatus as described above which has, coaxially with the rotating plate, a rotating assembly located therebeneath, the assembly having a downwardly flared annular skirt, an axially located hollow shaft extending within the skirt and having radially outwardly directed apertures, the shaft and skirt assembly having associated means to enable them to be rotated at a rate sufficient for liquid passing through the shaft and into the apertures to be accelerated outwardly and strike the interior of the skirt, to move down the skirt to its lower edge and to be expelled outwardly to strike the articles being delivered from the distribution plate and about the periphery of the skirt.

We may prefer to form the lower edge of the skirt in the form of a curve so that the liquid is expelled from the skirt at different axial distances.

In order that the invention may be more readily understood, we shall describe one embodiment thereof in association with apparatus designed to deliver animal feed pellets, which pellets are to be coated with fat to provide a required composition and which are to be delivered to a screw conveyor, say, for supply to a bagging machine.

In such applications there are two requirements.

Firstly, it is desirable that the pellets are evenly distributed and, secondly, it is most desirable that the pellets are consistent in fat quantity. These criteria are difficult to achieve.

Figure 2:
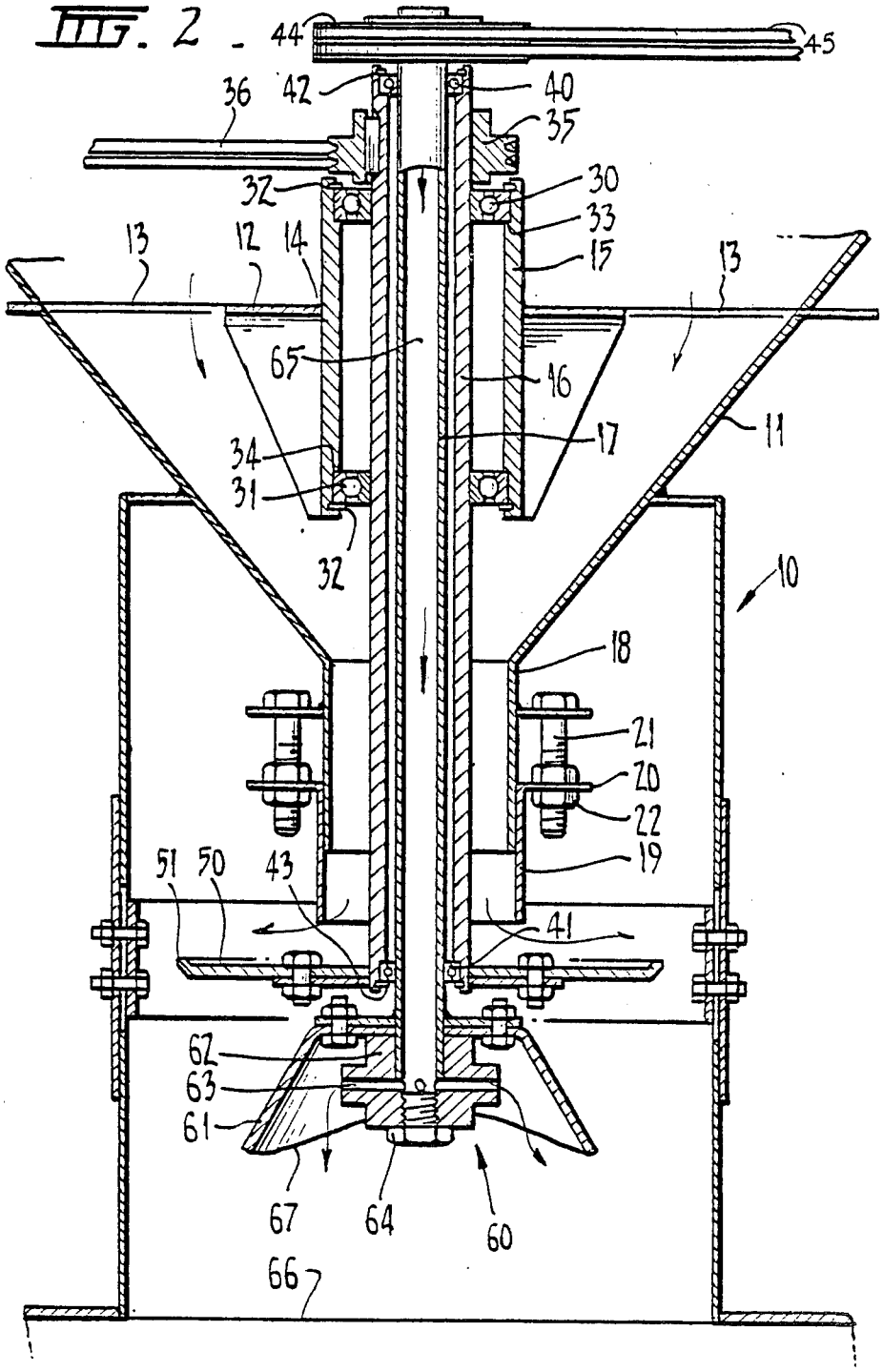

In order that the invention may be more readily understood, we shall refer to the accompanying drawings, in which:

FIG. 1 is effectively a schematic view, partly broken away, showing the apparatus of the invention; and FIG. 2 is a vertical section of the central portion of FIG. 1 showing the operative components thereof.

The apparatus is located within a housing 10 which has located therein a conical downwardly directed hopper 11 to which there may be connected means to deliver pellets thereto. Located across the hopper 11, part way along its length, there is a plate 12 which is attached to the frame. This plate is provided with apertures 13 by means of which pellets can pass from the hopper. We propose the use of two such apertures 13, diametrically opposed, and have found, in practice, that these provide a satisfactory delivery. An alternative is to provide a spider which could take the place of the plate. The plate 12 also has an aperture 14 which is coaxial with the hopper and which has located therein a mounting sleeve 15 to receive a pair of rotating shafts 16, 17, which will be described hereinafter.

The delivery end 18 of the hopper 11 is cylindrical in form and may have mounted thereabout a cylindrical skirt 19 which is adapted for axial movement relative to the delivery end 18. The skirt 19 is shown as having an outwardly directed flange 20 at its upper end through which passes a number of threaded members 21 which pass through a flange or extension from the delivery end 18 of the hopper. On rotation of the threaded members 21 or nuts 22 located beneath the flange 20 there is axial movement of the cylindrical skirt 19.

In the mounting sleeve 15 there are located upper and lower bearings 30, 31 and rotatably mounted in these bearings is the outer coaxial rotatable shaft 16. The bearings may be of any required form and may be held in place by circlips 32 or the like or in any other conventional manner and may be provided with sealing means as required. The bearings are located against shoulders 33, 34 formed in the mounting sleeve.

The outer shaft 16 has, above the upper bearing 30 in the mounting sleeve, a pulley 35 which can be driven by V-belts 36 or the like, by an electric motor 38 which may preferably be a variable speed motor or a fixed speed motor having a gear box associated therewith.

The inner shaft 17 is rotatably located within the outer shaft 16 by bearings 40, 41 adjacent the top and bottom of the outer shaft. Again, the bearings may be retained by circlips 42, 43 and may be provided with suitable seals. The shaft 17 is also provided with a pulley 44 driven by V-belts 45 or any other required manner from a motor 39 which may be of fixed or variable speed.

The inner shaft 17 has a hollow centre 65 and at its upper end is connected to a source of the required liquid, in this particular case, fat. The form of connection between a stationary fat supply and the rotating shaft is not shown but it is basically conventional.

Both of the shafts 16, 17 extend below the delivery end 18 of the hopper 11 with the inner shaft 17 extending below the outer shaft 16.

Located on the outer shaft and fixed relative thereto is a delivery plate 50. The delivery plate 50 is circular and, as illustrated, has a raised lip 51 about its periphery. In some applications such a lip is not necessary.

On the lower end of the inner shaft 17 there is provided an assembly 60 which comprises an outwardly and downwardly directed skirt 61 and a distribution block 62 which has a number, preferably four, radial apertures 63 which extend into the interior of the inner shaft 17. The lower end of the distribution block is closed by a plug 64.

The skirt may be of constant depth around its periphery but it is preferred to form the lower edge 67 of the skirt as a continuous curve.

The outer shaft 16 and thus the delivery plate 50 are rotated at a speed sufficient to give the required distribution of pellets, as will be described hereinafter. We have found for pellets it is satisfactory for the plate to rotate at approximately 100 rpm. It will be appreciated that this rate can be varied by varying the speed of the motor 38 or the ratio of the motor's gear box and different speeds will provide optimum results for articles of different weights.

The inner shaft 17 is adapted to rotate at a greater rate which will depend on the viscosity of the liquid being used and also the amount to be distributed. For the supply of fat to pellets we have found a satisfactory speed to be of the order of 1000 rpm.

The operation of the apparatus is as follows.

The motors cause the shafts 16, 17 to rotate, pellets are fed from the hopper 11 to its cylindrical delivery end 18 and liquid fat is passed into the hollow centre 65 of the inner shaft 17. As the pellets leave the delivery end 18 of the hopper 11 they are dropped on to the plate 50 and because of the the selected speed of rotation of this plate there is both a tendency for the pellets to distribute themselves evenly about the plate, because of the rotational and frictional forces, and they also tend to move radially across the plate, because of the rotational force, until they are finally distributed from the periphery of the plate and fall downwardly. If the plate has a lip 51 there tends to be a slight build up of pellets therebehind which, in some applications, aids in the even distribution of the pellets. We have found that the pellets leave the periphery of the plate in such a way that there is an extremely good, even distribution of pellets around the whole of the periphery of the plate.

At the same time, the fat passing down the hollow centre 65 of the inner shaft 17 is moved outwardly through the apertures 63 and, because of the relativly high speed of the shaft, is flung outwardly until it strikes the inner surface of the skirt and then, under gravity, moves downwardly whilst maintaining its position within the skirt because of the rotational forces until it reaches the bottom of the skirt, at which time it is flung outwardly and strikes the pellets as they fall through the area traversed by the fat.

Depending upon the rate of delivery of pellets and the amount of fat fed, so it can be arranged that the pellets are evenly coated with a predetermined amount of fat. The pellets, after coating, continue to fall and the fat dries or soaks into the pellets sufficiently to avoid any tendency to conglomerate. In the illustrated embodiment they then drop through an aperture 66 in the bottom of the housing 10 to, say, a screw conveyor inlet for delivery, such as for bagging.

The pellet delivery rate can be varied by varying the speed of rotation of the delivery plate 50 or by varying the location of the cylindrical skirt 19 relative to the plate 50 so that the mouth between the skirt and the plate is either widened or lessened thus varying possible pellet flow.

The fat distribution rate, if the fat is delivered under gravity, is partially dependent on the speed of rotation of the inner shaft and partially on the diameter of the apertures in the distribution block, as well as on the viscosity of the fat. Thus variation in flow can be obtained by altering the speed of rotation and/or the diameter of the apertures. Variation can also be obtained by delivering the fat under pressure.

The actual fat distribution as it leaves the skirt will vary depending upon the actual formation of the lower end of the skirt. Basically, if the skirt is simply pressed from a metal disc, there will tend to be flow radially outwardly although because of the turbulance caused by the rotating components there will be a variation of the distribution above and below this. However, by forming the lower edge 67 as a continuous curve it will be seen that there will be distribution of fat at various positions axially and the fat will provide a zone through which the pellets must pass. Because of the speed of rotation of the skirt, we have found that the fat is effectively atomised and a very fine spray is obtained.

The application of the invention, as we previously indicated, is not restricted to the application of fat on to pellets but can be extended to many other areas where it is either desirable to coat particular articles with a coating which should be even as, provided the fall below the area where the liquid is applied is sufficient for the coating to dry, then an even coating should be applied as there is little contact between the articles. The invention is also applicable in other applications where it is desirable to apply a liquid to an absorbent article where even distribution of the liquid is required.

Many modifications may be made in the particular form of the delivery plate and skirt and the drive to the shafts may be varied in any manner known to the art, preferably so that the speed of one shaft relative to the other can be readily varied although in a specific application it may be that both shafts can be driven from the one source simply by different gearing to the two shafts.

I claim:

1. Apparatus for coating discrete articles comprising:

supply means having a downwardly directed delivery means for discharging a continuous feed of articles;

a rotating plate beneath said supply means for receiving the articles, said plate rotating at a speed sufficient to force articles off the edge of the plate in an even peripheral distribution; and a rotating coating assembly located below said plate, the assembly having a downwardly flared rotating annular skirt and fluid feed means extending within the skirt, said fluid feed means having radially outwardly directed aperatures for applying fluid to the interior of the skirt, said skirt rotating at a rate sufficient for fluid to move down the skirt to its lower edge and be expelled outwardly therefrom to strike the articles falling from the rotating plate and about the periphery of the skirt, the lower edge of said annular skirt being in the form of a continuous curve varying in the axial direction of the skirt to form an axial zone of fluid through which the articles fall for coating.

2. Apparatus as claimed in claim 1 wherein the feed of the articles to the plate is provided from two diametrically opposed outlets from the supply means.

3. Apparatus as claimed in claim 1 wherein the plate is rotated on a shaft located centrally of the delivery means.

4. Apparatus as claimed in claim 3 wherein the shaft passes downwardly through the delivery means.

5. Apparatus as claimed in claim 3 wherein said rotating coating assembly has an axially located hollow, fluid feed shaft extending within the skirt and wherein said hollow feed shaft is located for rotation within said shaft of said plate.

6. Apparatus as claimed in claim 1 wherein the plate has a peripheral lip.

7. Apparatus as claimed in claim 1 wherein the downwardly directed delivery means has a skirt moveable toward and away from said plate so the spacing between the plate and the skirt can be varied.

8. Apparatus as claimed in claim 1 wherein said rotating coating assembly has an axially located hollow, fluid feed shaft extending within said skirt, and wherein said fluid feed shaft has a distribution block including said radially outwardly directed apertures.

9. Apparatus as claimed in claim 1 wherein said rotating plate and rotating coating assembly are positioned within a stationary casing.

* * * * *